US007781709B1

(12) United States Patent
Jones et al.

(10) Patent No.: US 7,781,709 B1
(45) Date of Patent: Aug. 24, 2010

(54) SMALL CALIBER GUIDED PROJECTILE

(75) Inventors: James F. Jones, Albuquerque, NM (US); Brian A. Kast, Albuquerque, NM (US); Marc W. Kniskern, Albuquerque, NM (US); Scott E. Rose, Albuquerque, NM (US); Brandon R. Rohrer, Albuquerque, NM (US); James W. Woods, Albuquerque, NM (US); Ronald W. Greene, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 199 days.

(21) Appl. No.: 12/241,410

(22) Filed: Sep. 30, 2008

Related U.S. Application Data

(60) Provisional application No. 61/050,310, filed on May 5, 2008.

(51) Int. Cl.

| | |
|---|---|
| ***F42B 15/01*** | (2006.01) |
| ***F42B 10/64*** | (2006.01) |
| ***F41G 7/22*** | (2006.01) |
| *F42B 15/00* | (2006.01) |
| *F42B 10/60* | (2006.01) |
| *F41G 7/00* | (2006.01) |

(52) U.S. Cl. ..... 244/3.16; 244/3.1; 244/3.15; 244/3.24; 102/382; 102/384

(58) Field of Classification Search ..... 244/3.1–3.3; 89/1.11; 102/382, 384, 430, 439

See application file for complete search history.

(56) References Cited

U.S. PATENT DOCUMENTS

| | | | | |
|---|---|---|---|---|
| 46,490 | A | | 2/1865 | Orwig |
| 412,670 | A | | 10/1889 | Ross |
| 1,243,542 | A | | 10/1917 | Moore |
| 1,277,942 | A | | 9/1918 | Kaylor |
| 3,125,313 | A | | 3/1964 | Soderberg |
| 3,658,427 | A | * | 4/1972 | DeCou ..... 244/3.16 |
| 3,695,556 | A | * | 10/1972 | Gauzza et al. ..... 244/3.29 |
| 3,841,585 | A | * | 10/1974 | Evers-Euterneck ..... 244/3.15 |
| 3,860,199 | A | | 1/1975 | Dunne |

(Continued)

OTHER PUBLICATIONS

Salguero, D.E., "Trajectory Analysis and Optimization System (TAOS) User's Manual", SAND95-1652, Sandia Corporation, Printed Dec. 1995, available through OSTI.

(Continued)

*Primary Examiner*—Bernarr E Gregory
(74) *Attorney, Agent, or Firm*—William R. Conley

(57) ABSTRACT

A non-spinning projectile that is self-guided to a laser designated target and is configured to be fired from a small caliber smooth bore gun barrel has an optical sensor mounted in the nose of the projectile, a counterbalancing mass portion near the fore end of the projectile and a hollow tapered body mounted aft of the counterbalancing mass. Stabilizing strakes are mounted to and extend outward from the tapered body with control fins located at the aft end of the strakes. Guidance and control electronics and electromagnetic actuators for operating the control fins are located within the tapered body section. Output from the optical sensor is processed by the guidance and control electronics to produce command signals for the electromagnetic actuators. A guidance control algorithm incorporating non-proportional, "bang-bang" control is used to steer the projectile to the target.

13 Claims, 9 Drawing Sheets

U.S. PATENT DOCUMENTS

| | | | | | |
|---|---|---|---|---|---|
| 3,977,629 | A | | 8/1976 | Tubeuf | |
| 4,153,224 | A | * | 5/1979 | Rampolla et al. | 244/3.16 |
| 4,318,515 | A | * | 3/1982 | Leek | 244/3.16 |
| 4,407,465 | A | | 10/1983 | Meyerhoff | |
| 4,431,147 | A | * | 2/1984 | Paley | 244/3.3 |
| 4,431,150 | A | | 2/1984 | Epperson, Jr. | |
| 4,537,371 | A | | 8/1985 | Lawhorn et al. | |
| 4,554,871 | A | * | 11/1985 | Nixon | 244/3.19 |
| 4,561,357 | A | * | 12/1985 | Maudal et al. | 102/439 |
| 4,565,340 | A | * | 1/1986 | Bains | 244/3.28 |
| 4,568,040 | A | | 2/1986 | Metz | |
| 4,783,382 | A | | 11/1988 | Benedick et al. | |
| 4,941,627 | A | * | 7/1990 | Moscrip | 244/3.21 |
| 4,978,088 | A | | 12/1990 | Himmert et al. | |
| 5,048,772 | A | * | 9/1991 | Wisshaupt | 244/3.23 |
| 5,085,380 | A | | 2/1992 | Barton | |
| 5,088,658 | A | * | 2/1992 | Forsmo | 244/3.21 |
| 5,139,216 | A | | 8/1992 | Larkin | |
| 5,430,449 | A | * | 7/1995 | Frazho et al. | 244/3.15 |
| 5,480,111 | A | * | 1/1996 | Smith et al. | 244/3.27 |
| 5,593,110 | A | * | 1/1997 | Ransom et al. | 244/3.23 |
| 5,775,636 | A | * | 7/1998 | Vig et al. | 244/3.24 |
| 5,788,178 | A | | 8/1998 | Barett, Jr. | |
| 6,237,496 | B1 | * | 5/2001 | Abbott | 102/384 |
| 6,283,407 | B1 | | 9/2001 | Hakenesch | |
| 6,422,507 | B1 | | 7/2002 | Lipeles | |
| 6,467,722 | B1 | * | 10/2002 | Berry et al. | 244/3.21 |
| 6,474,593 | B1 | | 11/2002 | Lipeles et al. | |
| 6,474,594 | B1 | * | 11/2002 | Johnson et al. | 244/3.24 |
| 6,548,794 | B2 | * | 4/2003 | Facciano et al. | 244/3.1 |
| 6,565,036 | B1 | * | 5/2003 | Palathingal et al. | 244/3.16 |
| 7,255,304 | B2 | | 8/2007 | Ericson et al. | |
| 7,354,017 | B2 | | 4/2008 | Morris et al. | |

OTHER PUBLICATIONS

Guidotti, R.A., "A Miniature Shock-Activated Thermal Battery for Munitions Applications", SAND98-0940, Sandia Corporation, Printed Apr. 1998, available through OSTI.

* cited by examiner

Turbulent Center of Pressure (% of L)
65.0
60.0
55.0
50.0
45.0
40.0
0.50
1.00
1.50
2.00
2.50
3.00
3.50
Mach Number Velocity (m/s)
1200
1000
800
600
400
200
0
0
500
1000
1500
2000
Range (m)
Std. 50 Cal Bullet
Guided Projectile

SMALL CALIBER GUIDED PROJECTILE

RELATED APPLICATIONS

This application claims the benefit of U.S. Provisional Application No. 61/050,310 filed on May 5, 2008, the entirety of which is herein incorporated by reference.

STATEMENT REGARDING FEDERALLY SPONSORED RESEARCH OR DEVELOPMENT

The United States Government has certain rights in this invention pursuant to Department of Energy Contract No. DE-AC04-94AL85000 with Sandia Corporation.

FIELD OF THE INVENTION

The invention generally relates to non-spinning projectiles (e.g. bullets) adapted to be fired from smooth bore gun barrels, the projectiles being self-guided to a target illuminated by a laser target designator. The invention additionally relates to non-spinning small caliber projectiles having a forward viewing optical sensor, control and guidance electronics, fixed strakes and electromagnetically actuated control fins for steering a projectile towards the target.

BACKGROUND OF THE INVENTION

Self guided projectiles (e.g. bullets) as can be fired from small caliber weapons (e.g. on the order of fifty (.50) caliber) are desired to increase the accuracy of placing the projectile on a target from long range (e.g. 2000 meters and beyond). Laser target designators have been used to illuminate (e.g. designate) a target in combination with optical sensors, guidance electronics and control surfaces within larger projectiles such as missiles, to guide the larger projectiles to their targets. To date, these systems have been impractical to realize within the size, weight, volume and cost constraints of small arms munitions. Earlier approaches to imparting guidance to small caliber munitions include spinning the projectile (or portion thereof) to provide aerodynamic stability, which greatly increases the complexity of the guidance electronics actuating control surfaces, timed for when the projectile is in a proper orientation. De-spinning sections or a portion of the projectile again adds complexity and cost to the projectile. These earlier approaches can also involve the use of drag inducing control surfaces which are disadvantageous from their penalty on the performance of the projectile (e.g. by reducing projectile velocity and range). What is needed are guided projectiles suitable for use in small caliber munitions that achieve aerodynamic stability without the added complexity and cost associated with spinning the projectile (or portion thereof) are steered by lift inducing surfaces as opposed to drag inducing surfaces, and have the required power, control and guidance electronics, and actuator systems fitted within a mold line as can be accommodated in a small caliber package.

BRIEF DESCRIPTION OF THE DRAWINGS

The accompanying drawings, which are incorporated in and form part of the specification, illustrate several embodiments of the present invention and, together with the description, serve to explain the principles of the invention. The drawings provided herein are not drawn to scale.

DETAILED DESCRIPTION OF THE INVENTION

While exemplary embodiments of the invention are described in terms of a projectile suitable for incorporation into .50 caliber munitions, embodiments of the present invention are not limited to this specific caliber. The following US Patents are hereby incorporated by reference, in their entirety into the present disclosure: U.S. Pat. Nos. 6,474,593 and 6,422,507 to Lipeles et al., U.S. Pat. No. 5,788,178 to Barrett, Jr., and U.S. Pat. No. 4,407,465 to Meyerhoff. In the event of an inconsistency in the disclosures of the above listed references and the present disclosure, the text of the present disclosure shall govern.

Small caliber projectiles are typically spun at very high rates to provide aerodynamic stability to the projectile during flight. Spinning of these projectiles is caused by the interaction of the body of the projectile with the rifled internal surface of a typical gun barrel. A typical .50 caliber bullet rotates approximately 2400 rev/sec upon exiting a gun barrel, which could generate in excess of 100,000 g's of centripetal acceleration. In order to simplify the control system and facilitate mechanical integrity of self-guided projectiles, the projectiles of the present invention are intended to be non-spinning (i.e. non-spun) and are intended to be fired from a smooth bore gun barrel. A nominal spin rate of a few revolutions per second can be expected due to variabilities in environmental variables and the manufacture of projectiles and barrels. For the purpose of the present disclosure the term "non-spinning projectile" refers to a projectile that does not require or utilize spinning to achieve aerodynamic stability, and is intended to be fired from a smooth bore barrel. A nominal spin rate (e.g. on the order of a few revolutions per second) of a "non-spinning" projectile may occur due to uncontrollable environmental and manufacturing factors.

Without spin stabilization, the principles of passive aerodynamic stability are employed to maintain controlled flight of projectiles according to the present invention. These include; moving the center of gravity forward in the un-spun projectile body as opposed to a typical .50 caliber spinning projectile wherein the center of gravity is toward the rear of the body, designing the projectile so as to ensure the aerodynamic center of pressure is aft of the center of gravity, lengthening the body of the projectile and, adding fixed fins (e.g. fixed strakes) along a length of the projectile body. Longer projectiles are practical within the bounds of typical .50 caliber cartridges. For an embodiment as described in the following examples and analyses, a projectile nominally 4 inches in length was selected which will easily fit within a standard .50 caliber cartridge's 5.45 inch overall length (e.g. standard .50 caliber "BMG" cartridge).

Figure 1:
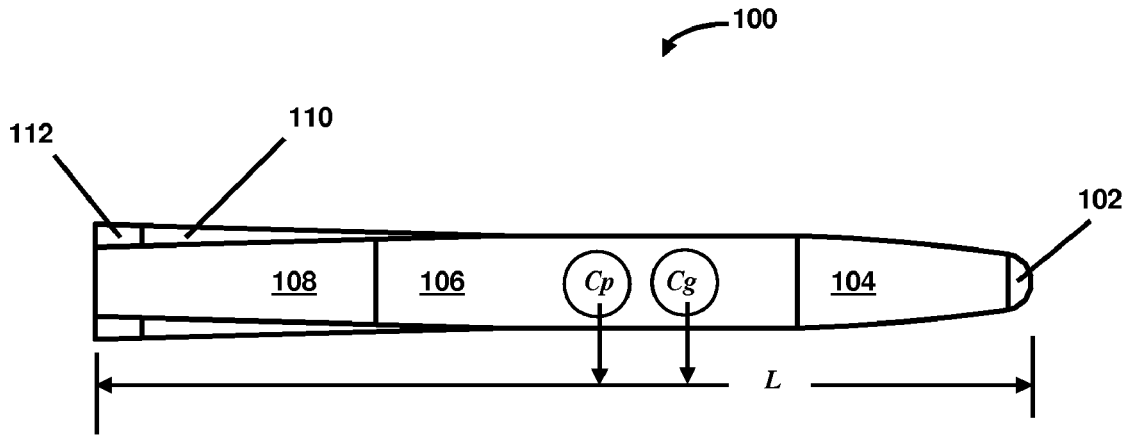
FIG. 1 is a schematic block diagram of an exemplary embodiment of a non-spinning guided projectile according to the present invention.

FIG. 1 is a schematic block diagram of an embodiment of a non-spinning self-guided projectile according to the present invention. Projectile 100 comprises a forward looking optical sensor 102 disposed in the nose of the projectile for detecting light reflected from a target illuminated by a laser target designator as is known in the art. A counterbalance mass 104 located in a forward section of the projectile 100 can comprise for example, a high density metal such as tungsten or depleted uranium. In the context of the present disclosure a high density metal refers to metals having a density greater than that of iron. One function of the counterbalance mass 104 is to cause the center of gravity "$C_g$" of the projectile 100 to occur at a location forward of the center of aerodynamic pressure "$C_p$" along the length of the projectile. As described below, this configuration imparts a degree of passive aerodynamic stability to the projectile. For some embodiments of the invention, it has been found that exemplary locations for the center of gravity of a projectile can occur within a range of from approximately 30% to 40% of the length of the projectile, as measured from the forward tip of the projectile towards the aft end of the projectile.

A guidance and control electronics module 106 can be located in the mid-body of the projectile and an actuator module 108 incorporating electromagnetic actuators to control the movement of control fins 112 for steering, can be located in the rear portion of the projectile. Guidance and control electronics module 106 and actuator module 108 can be contained within a hollow cylinder (e.g. tube) that forms a portion of the body of the projectile 100. Control fins 112 can be mounted towards the aft end of the projectile to increase their effectiveness, by creating a larger moment (e.g. leverage) about the projectile's center of mass. Rotation of the control fins 112 causes lift to be imparted to the projectile body, in contrast to the utilization of drag inducing control surfaces. Fixed strakes 110 located adjacent to and forward of the control fins 112 extend along the tapered profile of the projectile body and serve to impart an additional degree of passive aerodynamic stability to the projectile. An example of the operation of the projectile 100 is for the optical sensor 102 in combination with the guidance and control electronics module 106 to determine the orientation of the projectile with respect to a laser-designated target. That information is utilized within the guidance and control module 106 to generate command (e.g. drive) signals for the actuators within the actuator module 108. The actuators drive the control fins 112, correcting the projectile's attitude and steering it toward the target. In embodiments of the invention, this operation can be repeated approximately 30 times per second, which results in a projectile suitable for use against moving or stationary targets.

Figure 2:
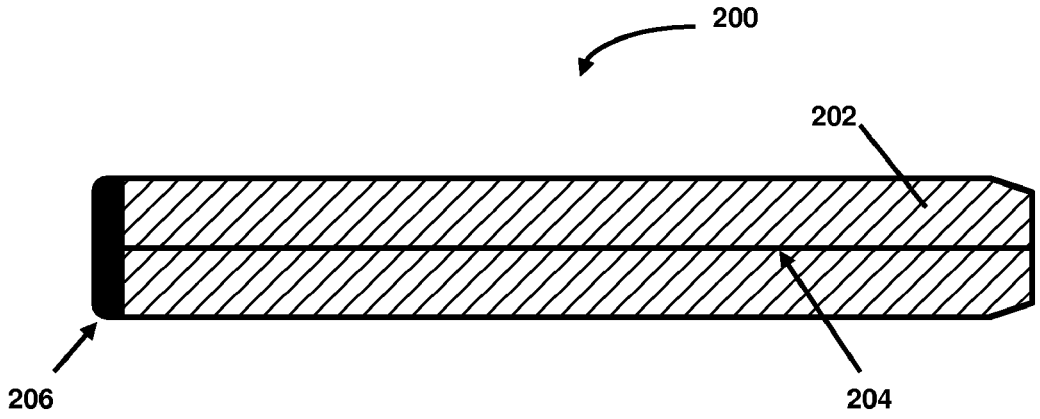
FIG. 2 is a schematic block diagram of an embodiment of a sabot as can be utilized in a non-spinning guided projectile according to the present invention.

FIG. 2 is a schematic block diagram of an embodiment of a sabot as can be utilized in conjunction with a non-spinning guided projectile according to the present invention. Embodiments of the present invention (such as illustrated in FIG. 1) incorporate control fins 112 and strakes 110 that extend from the tapered profile of the projectile body thereby not requiring post-firing deployment or extension of control fins or strakes from within the body of the projectile 100. This greatly reduces the complexity, cost, size and weight of the actuator mechanisms within module 108, which inter alia, allows fitting of these assemblies within the body of a small caliber munition. Sabot 200 comprises a sleeve 202 of material that surrounds at least a portion of the projectile and can be assembled with the projectile into a cartridge. Sabot 202 creates a smooth exterior mold line for the projectile body by filling in the space around control fins 112 and strakes 110, presenting a uniform surface to the gun barrel, thereby protecting fins 112 and strakes 110 from damage upon firing. Sabot 200 is separated and discarded from the projectile upon firing and can be fabricated from materials such as high service temperature polymers (e.g. polyimide based polymers) or metals, and can comprise several slits 204 along the length of the sabot 200 to facilitate separation of the sabot from the projectile upon exit from a gun barrel. In some embodiments of the sabot 200 manufactured from a polymer material, an end cap 206 made of a metal (e.g. brass, copper or aluminum) can be included to optimize the transfer of energy of the expanding gases from firing to the forward motion of the projectile 100.

Figure 3:
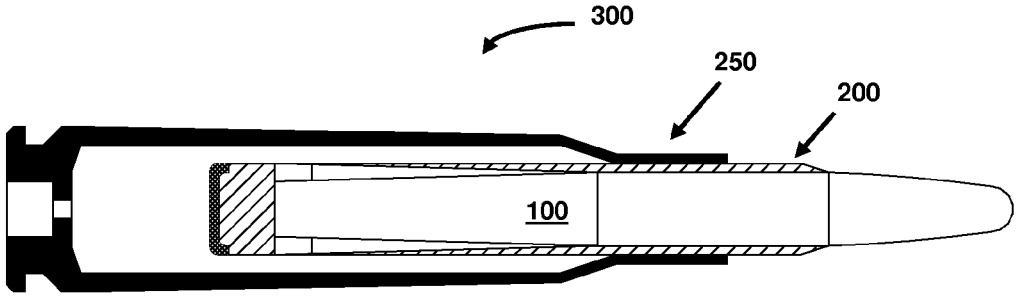
FIG. 3 is a schematic cross-sectional diagram of an embodiment of a non-spinning guided projectile and sabot of the present invention, assembled into a .50 caliber shell casing.

FIG. 3 is a schematic cross-sectional diagram of an embodiment of a non-spinning guided projectile and sabot of the present invention, assembled with a. 50 caliber shell casing. The cartridge assembly 300 comprises projectile 100 inserted in sabot 200 which is in turn inserted in shell casing 250. Shell casing 250 in this example is illustrative of a standard .50 caliber BMG casing. The void area around and behind sabot 200 would typically contain the propellant charge to fire the munition.

The following disclosure details the various elements of embodiments of non-spinning self-guided projectiles according to the present invention, and analyses of these elements performed using commonly known mechanical design and simulation codes. For example; "Missile Datcom" and "TAOS" codes (see Salguero, D. E. "Trajectory Analysis and Optimization System (TAOS) User's Manual", SAND95-1652, Sandia National Laboratories, printed December 1995, available through OSTI.

Considering a projectile as illustrated in FIG. 1, the structure of the projectile is designed to withstand an expected 120,000 g's of acceleration and 50,000 psi of pressure due to expanding gases within the barrel during firing. The rear of the projectile is relatively small and thus structurally well supported. The nose of the projectile can comprise a slug of high density metal (e.g. tungsten) with space in the nose of the slug for an optical sensor. The most vulnerable part of the structure is presumably the cylindrical sidewalls of the main projectile body (e.g. control and guidance section 106 and actuator section 108) and the axles onto which the control fins 112 are mounted. The following analysis indicates that values of 0.050" thick sidewalls and 0.025" diameter control fin axles allow for ample structural strength using readily available engineering steels.

Figure 4:
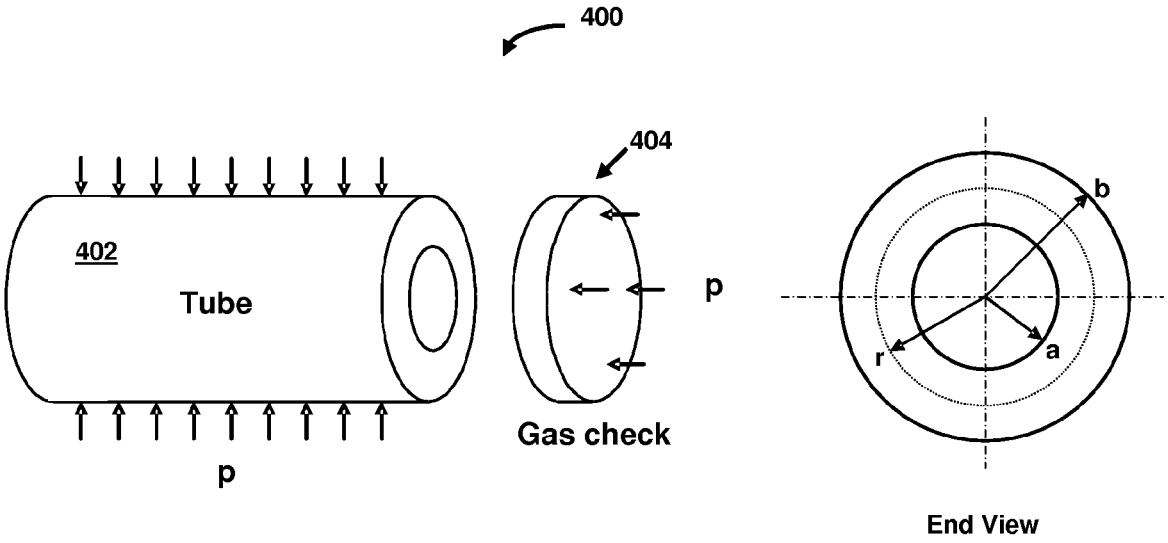
FIG. 4 is a schematic block diagram of a hollow portion of a guided projectile's body according to the present invention, and the stresses upon firing acting thereon.

The purpose of this analysis is to determine design parameters for the hollow guidance and actuator section(s) of the guided projectile to withstand the expected chamber pressure. The configuration is depicted in FIG. 4, wherein the hollow portion 400 of a projectile body is represented by a cylinder 402 and gas check 404 (e.g. end cap). The analysis is simplified to consist of one end of a hollow tube with a gas check which is surrounded by the chamber pressure "p". The other end of the tube is exposed to atmospheric pressure making the inside pressure effectively zero pressure. Note that the gas check is shown separated from tube for clarity but when assembled would form a "gas tight" seal against one end of the tube.

Radial stress in the tube wall is given by:

$$\sigma_r = \frac{p_i a^2 - p_o b^2 + a^2 b^2 (p_o - p_i)/r^2}{b^2 - a^2}. \quad \text{(Eqn. 1)}$$

Where:

$\sigma_r$=radial stress $p_i$=internal pressure $p_o$=external pressure a=inner radius of tube b=outer radius of tube r=radius of stress calculation The internal pressure is assumed to be zero and the external pressure is assumed to be a fraction of the chamber pressure, $p=p_{max}\times C$, where C is a reduction factor. Several factors cause the walls of the projectile to see a pressure that is reduced relative to that measured in the chamber. Fluidic factors: The small gap between the base of the projectile and the barrel wall restricts gas flow around the projectile, reducing pressures from those seen behind the projectile. This is especially true in a smooth-bore weapon, as is planned for firing embodiments of the present invention. In addition, as the projectile tapers toward its tip, the gap between the projectile and the bore wall increases, allowing gases that would otherwise exert pressure on the sidewalls to vent ahead of the projectile. Mechanical factors: The internal volume of the projectile body can be filled with an epoxy or elastomeric material, as in potting of the internal electronics, capable of supporting as stress as great as 10 ksi. This can reduce the radial and tangential stresses on the wall. The sabot surrounding the projectile may also relieve some fraction of the pressure applied.

Initial investigations suggest that a reduction factor of C=0.25 results in a conservative estimate of the sidewall pressure. Numerical calculation of stresses across the thickness of the wall indicates perhaps counter-intuitively, that the highest internal stresses occur at the internal surface of the cylindrical chamber wall. In this case (Eqn. 1) becomes;

$$\sigma_r = 0. \quad \text{(Eqn. 2)}$$

Tangential stress ($\sigma_t$) is given by;

$$\sigma_t = \frac{p_i a^2 - p_o b^2 - a^2 b^2 (p_o - p_i)/r^2}{b^2 - a^2}. \quad \text{(Eqn. 3)}$$

Applying the same assumptions as for radial stress (Eqn. 3) becomes;

$$\sigma_t = \frac{-pb^2 - a^2 b^2 p/r^2}{b^2 - a^2}. \quad \text{(Eqn. 4)}$$

Thus the tangential stress at the internal wall is;

$$\sigma_t = \frac{-2b^2}{b^2 - a^2} p. \quad \text{(Eqn. 5)}$$

To calculate the axial stress ($\sigma_l$), we will assume that a gas check transfers the force due to the chamber pressure to the end of the tube. The force applied to the gas check is;

$$F=\pi b^2 p. \quad \text{(Eqn. 6)}$$

Thus, axial stress may be calculated by dividing the applied force by the cross-sectional area of the tube wall and applying the sign convention positive tension;

$$\sigma_l = \frac{F}{A} = -\frac{\pi b^2 p}{\pi b^2 - \pi a^2}. \quad \text{(Eqn. 7)}$$

Reducing (Eqn. 7) gives;

$$\sigma_l = -\frac{b^2}{b^2 - a^2} p. \quad \text{(Eqn. 8)}$$

By the maximum shear-stress theory, the yield strength of the material used must be greater than the largest difference in normal stresses. In this case failure is avoided when;

$$S_y > |\sigma_r - \sigma_t| = \frac{2b^2 p}{b^2 - a^2}. \quad \text{(Eqn. 9)}$$

A more refined estimate can be made using octahedral shear stress theory (a.k.a. distortion energy or von Mises-Hinckey theory). In this case failure is avoided when;

$$S_y > \left[\frac{(\sigma_r - \sigma_t)^2 + (\sigma_t - \sigma_l)^2 + (\sigma_l - \sigma_r)^2}{2}\right]^{\frac{1}{2}} \quad \text{(Eqn. 10)}$$

which reduces to;

$$S_y > \sqrt{3}\,\frac{b^2 p}{b^2 - a^2}. \quad \text{(Eqn. 11)}$$

Figure 5:
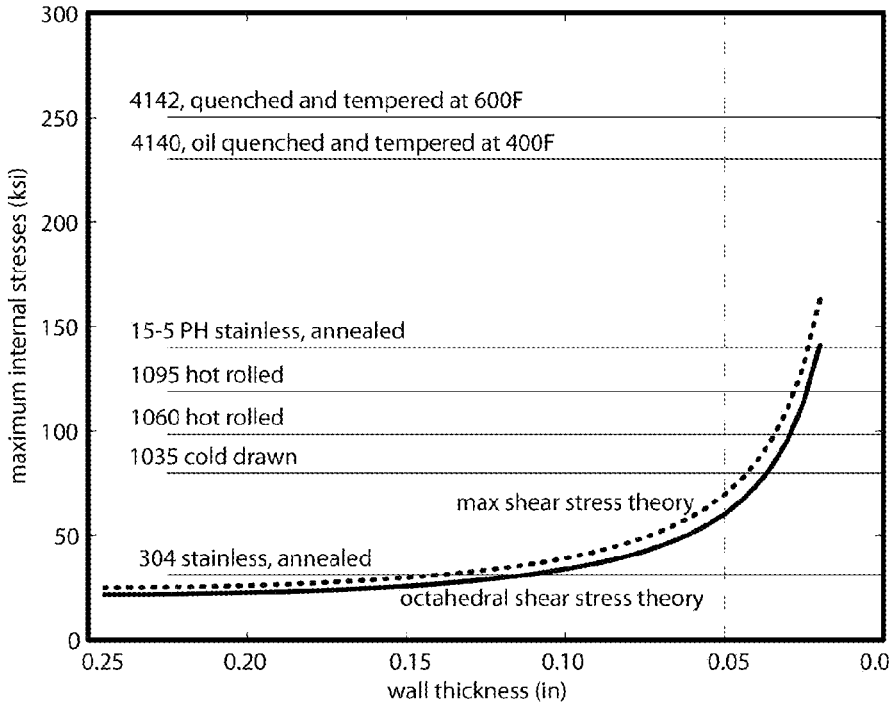
FIG. 5 is a graphical presentation of the results of a structural stress analysis for embodiments of guided projectiles according to the present invention.

The computed results are displayed graphically in FIG. 5 and compared with the yield stress of several steels. The computed maximum internal stresses in projectile structures as a function of sidewall thickness is shown according to both the maximum shear stress theory and the octahedral shear stress theory. The yield stresses of various steels are shown in comparison. The wall thickness of 0.050" was selected as a starting point for the other analyses described in this document. The figure shows that the materials listed, with the possible exception of annealed 304 stainless steel, could be used to build a projectile structure with 0.050" side walls capable of withstanding the pressures experienced during firing. Values for the yield stress of the various steels shown are adopted from commonly available resources.

Figure 6:
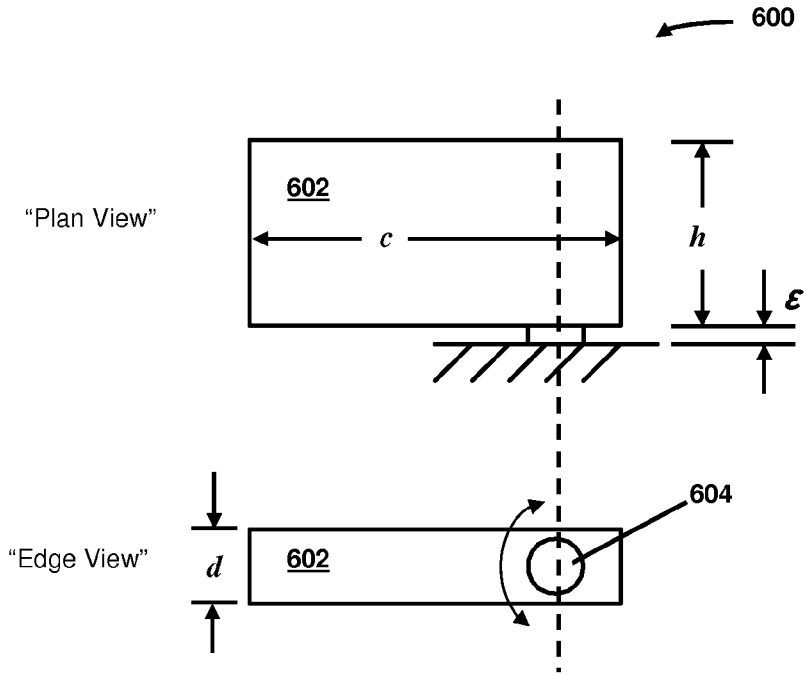
FIG. 6 is a schematic block diagram of a control fin and shaft configuration as can be used in embodiments of guided projectiles according to the present invention.

The following analysis was conducted to determine design parameters for a robust control fin-shaft assembly. FIG. 6 illustrates plan and edge views of a control fin assembly comprising control fin mounted on a rotatable shaft 604. Assuming that the control fin and the shaft may be fabricated from different materials, the mass of the assembly is given by;

$$m=\rho_f V_f+\rho_s V_s. \quad \text{(Eqn. 12)}$$

Where ρ is density, V is volume, and the subscripts f and s refer to the fin and the shaft respectively. Substituting geometric parameters for the fin and shaft geometries into (Eqn. 12) yields;

$$m=\rho_f\left[c\,d_f-\frac{\pi d_s^2}{4}\right]h+\rho_s\frac{\pi d_s^2}{4}h. \quad \text{(Eqn. 13)}$$

The stress in the shaft may be written as;

$$\sigma=-\frac{M\,y}{I}. \quad \text{(Eqn. 14)}$$

Since the shaft is round;

$$I=\frac{\pi d_s^4}{64}. \quad \text{(Eqn. 15)}$$

The maximum stress occurs at the outer fiber of the shaft, thus;

$$y=1/2d_s. \quad \text{(Eqn. 16)}$$

The maximum moment, M, is the applied load times the distance from the applied load to the base of the shaft. The applied load is the total mass times acceleration and the distance is from the base of the shaft to the center of mass, or;

$$M=1/2\ mah. \quad \text{(Eqn. 17)}$$

Substituting (Eqns. 15-17) into (Eqn. 14) and taking the absolute value gives;

$$\sigma=\frac{(1/2\,mah)(1/2\,d_s)}{\frac{\pi d_s^4}{64}}. \quad \text{(Eqn. 18)}$$

Simplifying yields;

$$\sigma=\frac{16\,mah}{\pi d_s^3}. \quad \text{(Eqn. 19)}$$

Next, the mass of the control fin and shaft assembly is calculated for two cases. In the first case, both the fin and the shaft are fabricated from steel. In the second case, the fin is of titanium and the shaft is steel. Using the appropriate dimensions, let $d_f=d_s=0.05$ inches
h=0.10 inches
c=0.20 inches
and,
ρ steel=0.289 $lb_m$ $lb_m/in^3$
$\rho_{Ti}$=0.163 $lb_m$ $lb_m/in^3$ Note that the diameter of the shaft is equal to the thickness of the fin for both cases. This gives for Case 1 (all Steel), $m_1=2.89\times10^{-4}$ $lb_m$ and, for case 2 (Titanium and Steel) $m_2=1.88\times10^{-4}$ $lb_m$. Next, the mass values and other parameters for both cases can be substituted into (Eqn. 19). Case 1 (all Steel) $\sigma_1$=141 ksi and for case 2 (Titanium and Steel) $\sigma_2$=92.0 ksi.

Since the yield stress of 410 SS is 178 ksi and $\sigma_1$ calculated for both cases is less than this value, the fin shaft may be fabricated using a commonly available engineering material. If sufficient mass could be removed from the fin structure it is possible the fin shaft could be fabricated from a 300 series stainless steel to reduce cost.

The following analysis indicates that the center of mass of projectiles according to the invention can be moved forward enough, i.e. forward of the projectile's center of pressure, along the length of the projectile to insure aerodynamic stability. A nominal length of 4 inches (~100 mm) has been selected for the exemplary embodiment of a guided projectile as shown in FIG. 1. It fits easily within the standard .50 caliber cartridge's 5.45 inch overall length and is long enough to stabilize the body. The center of mass is moved forward by using high density material (e.g. tungsten, depleted uranium) in the counterbalance portion of the projectile. Remaining portions of the projectile are determined by functional requirements. The fin actuators are in the rear portion as control fins are most effective where they have the longest moment (leverage) about the body's center of mass. The remainder of the interior is available for batteries and electronics.

Material density for the interior portion of the projectile was estimated at approximately 0.1 pounds per cubic inch (2.8 g/cc). Thus, higher density materials in the control fin actuators (described below) can be offset by utilization of lower density batteries and electronics and low density potting materials. Using standard densities for the tungsten and stainless steel portions of the projectile, the exemplary configuration produces a center of mass at approximately 39% of body length, as measured from the tip of the projectile, well forward to provide aerodynamic stability. Table 1 provides a summary of the analysis.

TABLE 1

| Mass contributions of selected sections | | | |
|---|---|---|---|
| Nose | Mass: 4.12E(−4) | Center: 7.79E(−2) | Moment: 3.20E(−5) |
| Ogive | Mass: 5.65E(−2) | Center: 6.24E(−1) | Moment: 3.52E(−2) |

TABLE 1-continued

| Mass contributions of selected sections | | | |
|---|---|---|---|
| Shell cylinder | Mass: 1.99E(−2) | Center: 1.63E(0) | Moment: 3.24E(−2) |
| Potted cylinder | Mass: 8.84E(−3) | Center: 1.63E(0) | Moment: 1.44E(−2) |
| Shell conic | Mass: 2.26E(−2) | Center: 3.03E(0) | Moment: 6.83E(−2) |
| Potted conic | Mass: 8.21 E(−3) | Center: 2.97E(0) | Moment: 2.43E(−2) |
| End cap | Mass: 2.05E(−3) | Center: 3.95E(0) | Moment: 8.10E(−3) |

Total mass: 1.19E(−1)Lbs
Center of mass: 1.54E(0)
Fraction of length: 0.39

The following analysis was conducted to illustrate that aerodynamic control capability of a projectile according to the invention, is suitable for use against either stationary or moving targets. For the exemplary guided projectile, the external mold-line, aerodynamic lifting surfaces, and control surfaces were designed to achieve adequate trajectory correction to address stationary or moving targets. In addition, the design provides aerodynamic stability without spinning the projectile upon exiting the barrel. For delivery of the projectile using a .50 caliber gun, the external mold-line of the projectile was constrained by the following criteria: minimum nose radius of 2.5 mm for optical sensor lens, maximum diameter of 12.7 mm, and a maximum length of 102 mm. Considering these constraints, the aerodynamic design of the projectile was developed to achieve the following performance requirements: minimum aerodynamic static margin of 10% of body length (L), minimum lateral acceleration of 10 g upon barrel exit (for trajectory correction). A static margin of 10% L will insure aerodynamic stability of the projectile without spinning, and a 10 g lateral acceleration upon barrel exit will provide trajectory correction for addressing fixed and moving targets.

Figure 7:
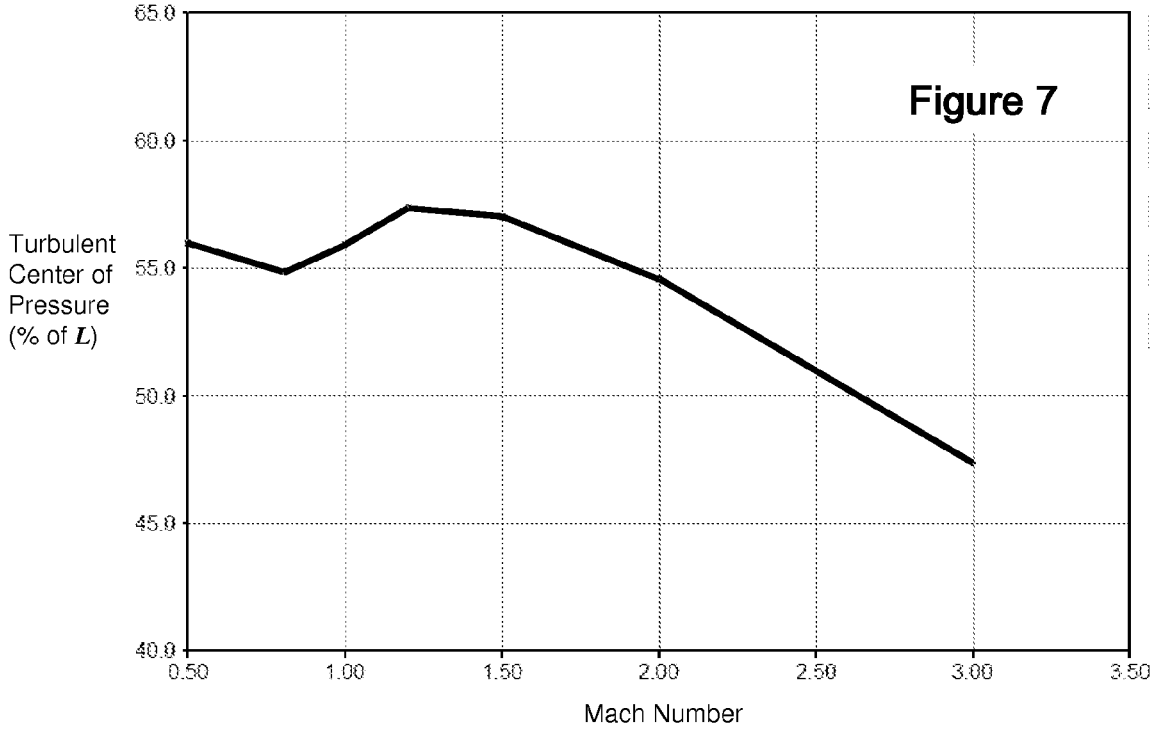
FIG. 7 is a graphical presentation of an aerodynamic analysis of an embodiment of a guided projectile according to the present invention.

Using the Missile Datcom code to compare the $C_p$ and $C_g$ of a projectile, the design of the aerodynamic lifting and control surfaces was analyzed considering the performance requirements for the projectile. This semi-empirical code is used for preliminary design of rocket and missile systems in the speed regimes and on the Reynolds number scales characteristic of the projectile. The maximum diameter of the projectile was reduced to 10.2 mm (12.7 mm for a standard .50 caliber projectile) to increase the span of the control fins and strakes necessary for aerodynamic stability. The control fins positioned at the base of the vehicle have a span and chord of 2.5 mm and 5.1 mm, respectively. The maximum deflection of the control surfaces is set to 3 degrees for this example. The results of the Datcom predictions are presented graphically in FIG. 7. The most forward position of the projectile's center of pressure occurs at Mach 3 and is positioned at 47% L from the physical nose-tip. For a center of gravity position of 37% L, the static margin of the projectile ranges from 10% L to 20% L over the flight Mach number regime. Analysis shows the trim angle of attack ($\alpha_{trim}$) of the projectile for a 3 degree fin deflection varies slightly with speed, but remains about 1.5 degrees. This trim angle is sufficient to achieve a 10 g lateral acceleration upon exiting the barrel.

Figure 8:
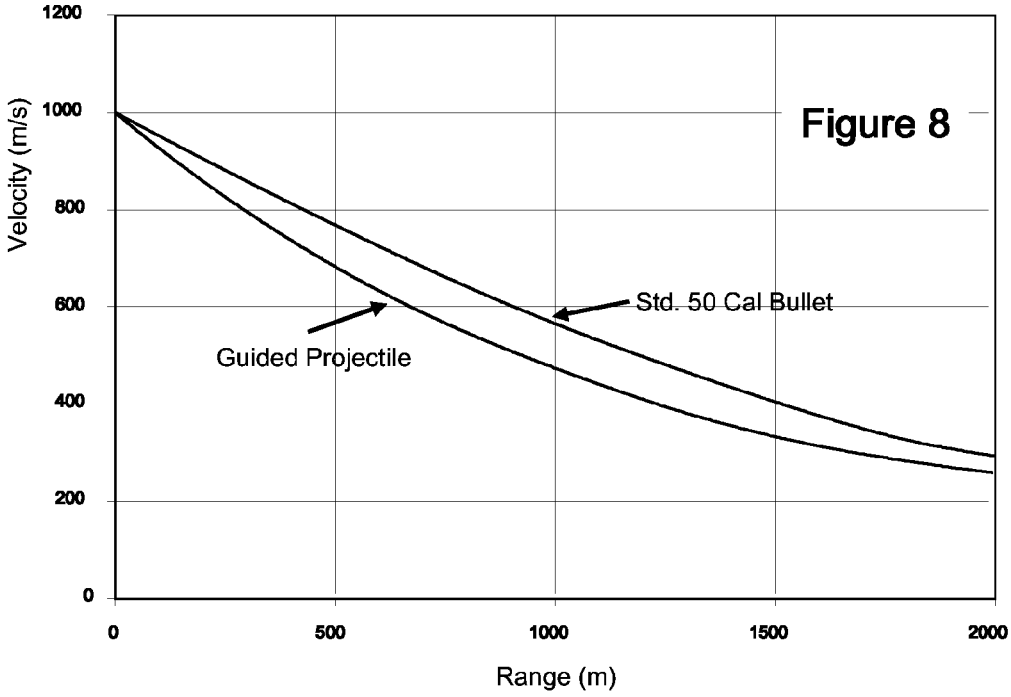
FIG. 8 is a graphical presentation of another aerodynamic analysis of an embodiment of a guided projectile according to the present invention.

Using the aerodynamic model obtained from Datcom, a three degree-of-freedom trajectory simulation was developed using the TAOS code. This simulation was used to investigate the flight performance of the guided projectile. For this simulation, the barrel exit velocity and mass of the projectile are 1000 m/s and 45 g, respectively. The results of this analysis are graphically illustrated in FIG. 8. The ballistic performance of the guided projectile (lower curve) is comparable to a standard .50-caliber bullet (upper curve). The lower velocity of the guided projectile results from increased nose bluntness as required by the lens of an optical sensor. At a range of 2000 m, the velocity of the guided projectile is 260 m/s compared to 300 m/s for a standard bullet. Full control fin deflection (3 degrees) can cause a trajectory deviation of 260 m at a range of 2000 m. For a maximum control fin deflection of 3 degrees, the maximum normal loading on the fin is 0.21 lb at barrel exit. This value can be used (as described below) to appropriately size the control actuators and batteries.

Figure 9:
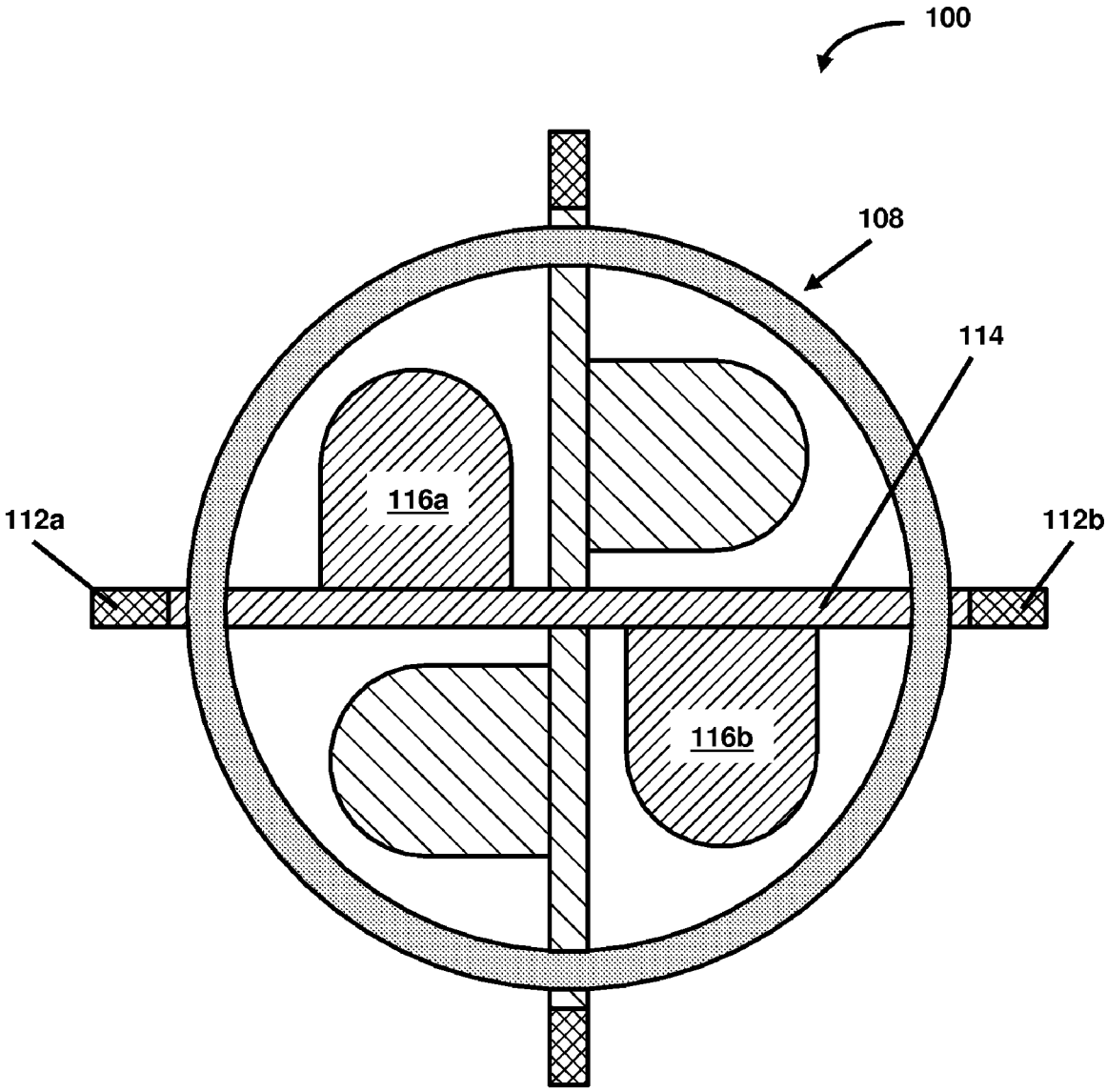
FIG. 9 is a cross-sectional schematic diagram of the actuator section of an exemplary embodiment of the invention.

FIG. 9 is a cross-sectional schematic diagram of the actuator section of the exemplary embodiment of the invention. The actuator section 108 of projectile 100 comprises control fins 112*a* and 112*b* mounted to a rotating shaft 114. Shaft 114 has an actuating lever 116*a* and opposed actuating lever 116*b* which for a force applied to lever 116*a* by an electromagnetic actuator, causes the shaft to rotate thereby deflecting the attached control fins, in this example by up to 3 degrees. Applying a force to the opposed lever 116*b* causes rotation of the control fins in the opposite direction. A similar analysis holds true for the pair of control fins mounted orthogonally. In this perspective as viewed from the aft end of the projectile looking forward, an electromagnetic actuator for each control lever and opposed control lever is positioned below the plane of the figure.

Figure 10:
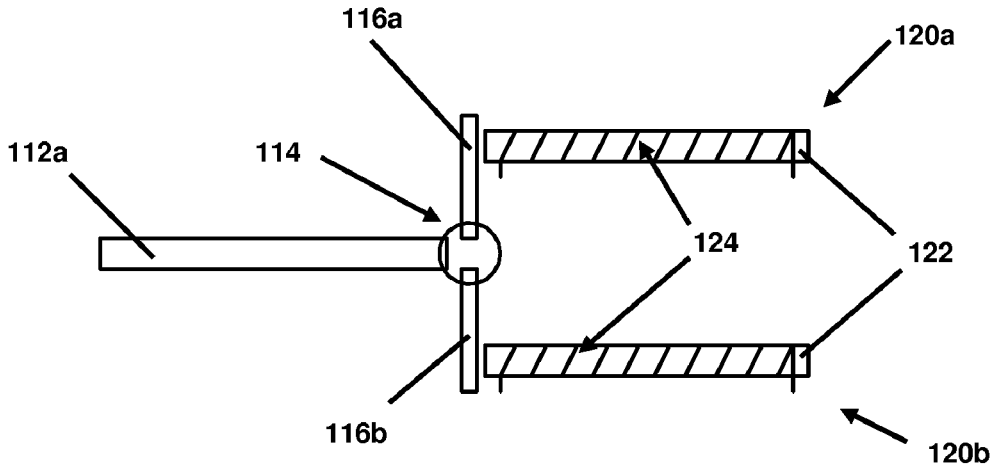
FIGS. 10 and 11 are schematic block diagram illustrations of an embodiment of an electromagnetic actuator and control fin assembly according to the invention.
Figure 11:
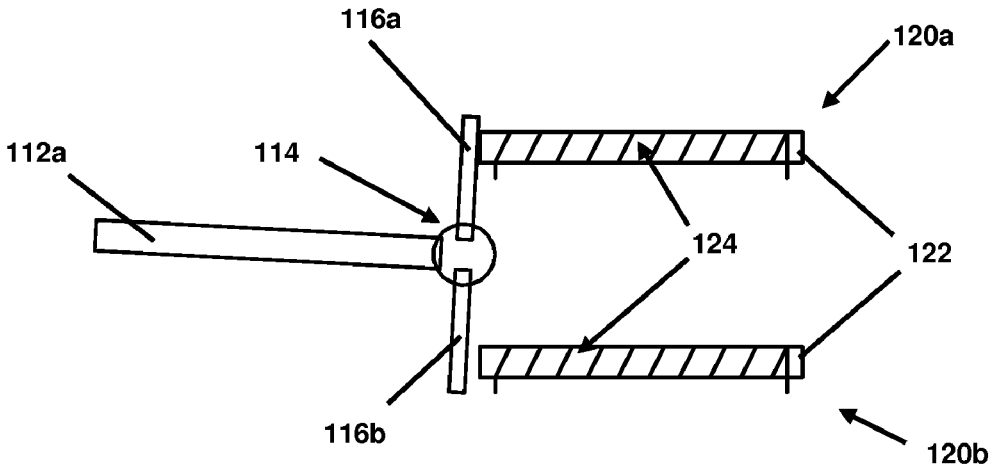

FIGS. 10 and 11 are schematic block diagrams of the control fin, shaft and actuator assembly for the control fin 112*a* of FIG. 9. Control fin 112*a* is mounted to axle 114 having control lever 116*a* and opposed control lever 116*b*, to which electromagnetic actuators 120*a* and 120*b* can be (respectively) magnetically coupled. Electromagnetic actuators 120*a* and 120*b* are illustrated as thin rods of ferromagnetic material 122 wrapped with coils of conductive wire 124. FIG. 11 illustrates that by applying a control command "on" to electromagnetic actuator 120*a*, and command "off" to actuator 120*b*, control lever 116*a* is magnetically pulled towards electromagnetic actuator 120*a*, causing control fin 112*a* to deflect "upwards" by the exemplary 3 degrees. Likewise, reversing the control commands would cause the control fin 112*b* to deflect "downwards".

The following analysis illustrates the performance of electromagnetic actuators for movement of the control fins in embodiments of the present invention. A fundamental requirement for the guided projectile is to change the flight path. As with most large scale systems, tail fins are an effective means to generate flight path corrections. Changing the control fin angle imparts a moment on the entire body, tilting it with respect to the velocity vector. The resulting aerodynamic pressure imbalance generates lateral acceleration which changes the velocity vector.

The performance targets for the exemplary guided projectile assume an aerodynamic side load on a control fin of approximately 0.02 pounds force maximum at 3 degrees deflection. The exemplary fins are 0.1 inches wide, 0.2 inches long, and pivot near their leading edge. The fins on opposed sides of the projectile body are directly coupled and are independent of the orthogonal pair. Each pair of control fins has 3 states: driven positive, driven negative (e.g. in an opposed direction), and neutral (both actuators "off"). These values can then be used to define the specifications for the fin actuator, enumerated in Table 2.

TABLE 2

| Fin actuation requirements | |
|---|---|
| Normal force (lbs) | 0.20 |
| Average moment arm (inches) | 0.10 |
| Fin shaft moment (inch-lbs) | 0.02 |
| Fin shaft moment (milli-Nm) | 2.26 |
| 2 fins (milli-Nm) | 4.52 |
| Attraction force (N) (lever = 1.2 mm) | 3.77 |
| Stroke (mm) (3 degrees @ 1.2 mm) | 0.063 |

Electromagnetic actuation as utilized in the actuator systems of embodiments of the present invention are versatile and easily controlled. They are simple mechanical devices, physically robust, and can be made to fit within the small confines of a guided projectile. The exemplary embodiment of the guided projectile has two electromagnetic actuators per pair of control fins, mounted lengthwise in the projectile body (e.g. within actuator module 108) illustrated notionally in FIGS. 1 and 9-11. One actuates positively while the other actuates in the opposed direction. A neutral state occurs when both actuator coils are un-powered (e.g. commanded "off"). As shown below, this configuration does not require any permanent magnets, although permanent magnets could be incorporated to extend the actuator performance if desired. The actuator system does not utilize feedback or proportional control of a control fin position, but could be used in a pulse-width modulation mode to achieve a crude form of proportional control.

Figure 12:
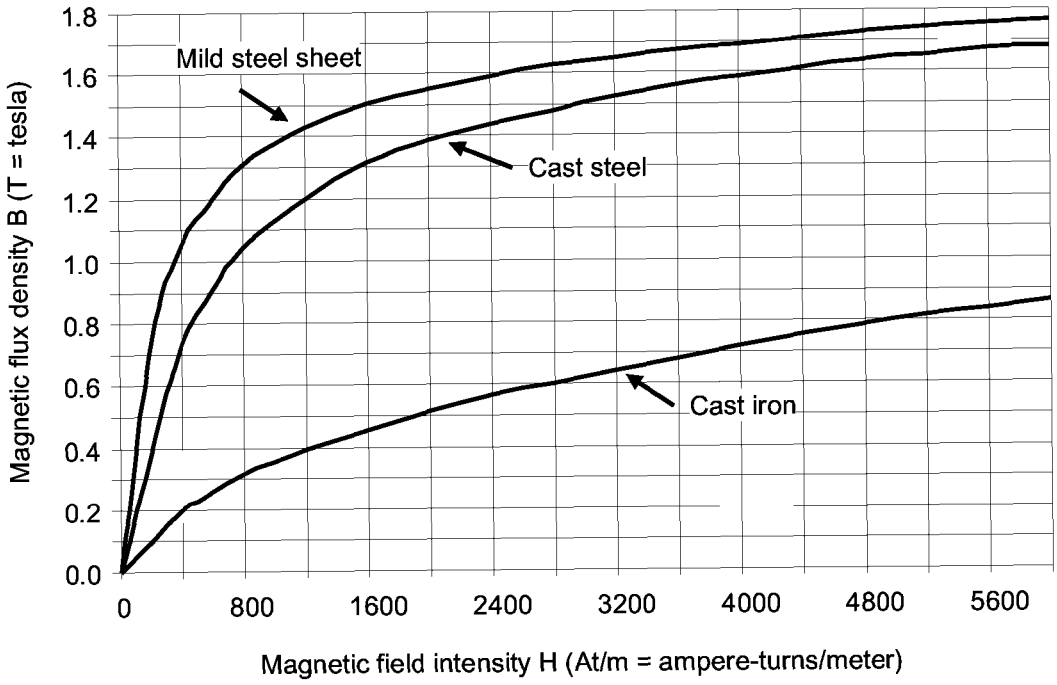
FIG. 12 is a graphical presentation of results for an electromagnetic analysis of an embodiment of an actuator according to the present invention.

Table 3 lists the parameters used to predict the operating performance of the exemplary electromagnetic actuators. FIG. 12 graphically presents the predicted performance for three common ferromagnetic core materials. While these values approach the magnetic saturation limits for soft steel, the results illustrate the required functionality for the electromagnetic actuators is achievable using common engineering materials for the cores of the actuators.

Analysis shows that using 38 gauge magnet wire provides a good match to the electrical power available. The current load significantly exceeds recommendations for that gauge. There will not be any cooling for this device, so it must be capable of surviving 5 seconds (e.g. typical flight time of a projectile) of operation relying on thermal mass alone. Even with 100% duty cycle, the thermal rise is not a concern during the expected flight time as shown in Table 4. Although direct actuation via electromagnets may not be as electrically efficient as other methods, it does provide a simple, physically robust, and inexpensive solution.

The nominal budget for the system power of the exemplary guided projectile is 3 W. Two watts are budgeted for the control fin actuators (assuming 35 actuations/sec/fin, 300% friction losses, 10% actuator efficiency, and a safety factor of 4) and 1 W for the electronic guidance and control features. Actual system power consumption will be dependent on a given application's configuration. Basic principles indicate that there is available payload capacity for carrying more than enough energy to perform the trajectory control. Assuming a minimum supply voltage of 3V to support control logic, the batteries should provide 1 A of current to produce 3 W. 1 A for 5 seconds is ~1.4 mA hours, less than 5 mW hours. That works out to about 15 mg of active material for a good Li/MnO2 cell and around 120 mg for an old carbon-zinc cell. The vast majority of commercial button cells are optimized for maximum energy storage and delivery over very long periods, often years. The primary cells optimized for higher power ratings tend to use larger packages. However, a custom-designed two-cell Lithium system can provide extra voltage to overcome internal resistance in the batteries.

TABLE 3

| Parameters for calculating electromagnet performance. | |
|---|---|
| Mass of object to lift, M (kg) | 0.1 |
| Force required to lift object, F (N) | 0.98 |
| Total required Magnetomotive force, MMFtotal (At) | 189.6 |
| Available current, lavail (amps) | 0.5 |
| Minimum number of required turns | 379.2 |
| Air gap | |
| Area of first pole, Ap_1 (mm^2) | 1 |
| Length of first air gap, Lag1 (mm) | 0.1 |
| Area of second pole, Ap_2 (mm^2) | 1 |
| Length of second air gap, Lag2 (mm) | 0.1 |
| Required magnetic flux density to lift object, Breq (Tesla) | 1.110 |
| Magnetic field intensity Fm @ Breq, MMFag (At) | 176.6 |
| Required magnetic circuit flux, phi (Wb) | 1.11E−06 |
| Lifting magnet | sheet steel |
| Section 1 | |
| Magnetic circuit path length, L_1 (mm) | 10 |
| Magnetic circuit path area, A_1 (mm^2) | 1 |
| Flux density, B_1 (Tesla) | 1.110 |
| From B-H curve, magnetic field intensity, H_1 (At/m) | 500 |
| Magnetomotive force (MMF), MMF_1 (At) | 5 |
| Section 2 | |
| Magnetic circuit path length, L_2 (mm) | 3 |
| Magnetic circuit path area, A_2 (mm^2) | 1 |
| Flux density, B_2 (Tesla) | 1.110 |
| From B-H curve, magnetic field intensity, H_2 (At/m) | 500 |
| Magnetomotive force (MMF), MMF_2 (At) | 1.5 |
| Section 3 | |
| Magnetic circuit path length, L_3 (mm) | 10 |
| Magnetic circuit path area, A_3 (mm^2) | 1 |
| Flux density, B_3 (Tesla) | 1.110 |
| From B-H curve, magnetic field intensity, H_3 (At/m) | 500 |
| Magnetomotive force (MMF), MMF_3 (At) | 5 |
| Object being lifted | sheet steel |
| Magnetic circuit path length, Lobl (mm) | 3 |
| Magnetic circuit path area, Aobl (mm^2) | 1 |
| Flux density, Bobl (Tesla) | 1.110 |
| From B-H curve, magnetic field intensity @ Breq, Hobl (At/m) | 500 |
| Magnetomotive force (MMF), MMFobl (At) | 2 |
| Permeativity of free space, mu0 (H/m) | 1.26E−06 |

TABLE 4

| Actuator thermal heating | | | | | | |
|---|---|---|---|---|---|---|
| | | | | Specific heat | | |
| | mm3 | cm3 | g | J/g/K | J/K | K/J |
| iron | 20 | 0.020 | 0.157 | 0.450 | 0.07 | 14.12 |
| copper | 14 | 0.014 | 0.125 | 0.385 | 0.05 | 20.71 |
| combined | | | | | 0.12 | 8.39 |
| | Power | | | 1.53 | J/s | |
| | Time | | | 5 | s | |
| | Energy | | | 7.65 | J | |
| | Temp rise | | | 64.22 | degrees K | |

Shock activated batteries could as well be utilized to provide power for embodiments of guided projectiles according to the present invention. Shock activated batteries are described in detail elsewhere, for example in U.S. Pat. No. 4,783,382 to Benedick et al., and in Guidotti et al., "A Miniature Shock-Activated Thermal Battery for Munitions Applications", SAND98-090438, Sandia National Laboratories, printed 1998, available through OSTI and presented at the 38th Annual Power Sources Conference, Cherry Hill, NJ, Jun. 8-11, 1998, the entirety of each of which is incorporated herein by reference. Shock activated batteries include shock activated thermal batteries that comprise for example, electrolytes stored as powders or pressed-powder pellets (i.e. "dry electrolytes") that become molten, i.e. active, by the action of the mechanical shock wave generated by detonating the charge within a cartridge, to fire the projectile. Exemplary electrolytes for shock activated batteries include LiBr—KBr—LiF (lithium bromide-potassium bromide-lithium fluoride) and LiCI-KCI (lithium chloride-potassium chloride), which can be used in combination with LiSi—$FeS_2$ electrochemical couples (e.g. anode-cathode pairs). Shock activated batteries can be an attractive solution to powering small caliber guided munitions by providing long storage life in an un-activated "dry" state, being "activated" or "turned on" only at such time as the cartridge containing the guided projectile is fired, and providing a suitably high output over a short duration of time.

Guidance of embodiments of projectiles according to the present invention comprises laser designating a target and receiving the laser's light reflected from the target by an optical sensor, such as a multi-segment photodiode. Electrical signals output from the optical sensor can be processed by an ASIC (Application Specific Integrated Circuit) or similar processor for generating the control commands for the electromagnetic actuators driving the control fins. A "bang-bang" control system derived from the control systems used on early guided bombs, such as the GBU-10 (Paveway series) can be implemented for embodiments of the present invention. This approach to a guidance system can be used to deflect the control fins to their maximum value of 3 degrees to maintain alignment of the projectile's longitudinal axis with the instantaneous line-of-sight to the target. For guided bombs, "bang-bang" control was replaced by proportional navigation in the 1970's to improve the accuracy. However, for the guided projectile, "bang-bang" control is adequate because of inherent performance advantages of the guided projectile's small scale. As the size of a flight vehicle is reduced, the aerodynamic frequency increases inversely with its scale. As a result, the response of the guided projectile to guidance commands will improve nearly two orders of magnitude relative to a 1000 lb guided bomb. This improved response allows the use of less complex guidance systems (e.g. "bang-bang") that can be more easily accommodated within the tight spatial confines of a small caliber projectile, while providing adequate targeting performance.

Figure 13:
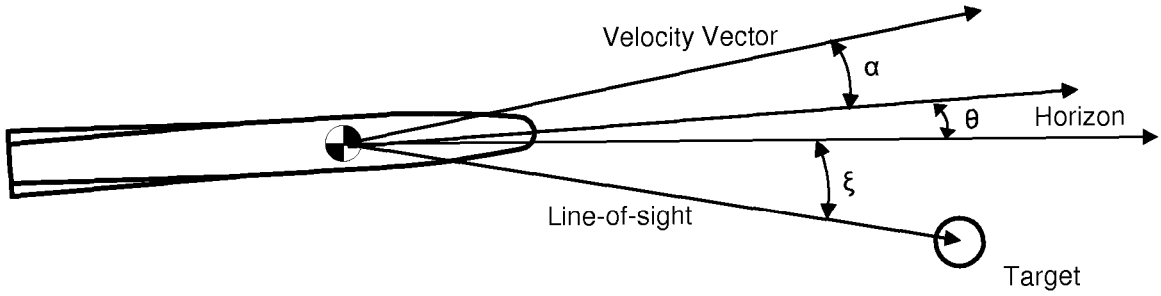
FIG. 13 is a schematic block diagram of an embodiment of a guidance algorithm for guided projectiles according to the present invention.

An analysis was performed to predict the flight performance of embodiments of the present guided projectile using a guidance algorithm and aerodynamic model developed for the projectile. FIG. 13 illustrates the guidance algorithm developed for the projectile which attempts to steer the nose of the projectile toward the target throughout the projectile's flight. Should the nose of the guided projectile point away from the target, the control fins will be deflected to move the nose toward the target; producing an acceleration normal to the velocity vector thereby rotating the velocity vector in the direction of the projectile's nose. This guidance methodology differs from the "bang-bang" control of early guided bombs as earlier guided bombs have a moveable seeker positioned on an aerodynamically stable nose-tip. The nose-tip on the earlier bombs can pitch and yaw to maintain alignment of the seeker with the bomb's velocity vector. Therefore, guidance commands (fin deflections) will occur only when the velocity vector is not aligned with the target. Clearly, maintaining alignment of the projectile's velocity vector with the target is the best way to guide the projectile; however, the added mechanical complexity of a moving nose-tip is avoided in the present embodiments of guided projectiles resulting in simpler, more compact guidance systems. Unlike the guided bombs, the present projectile's guidance system maintains alignment of the projectile's nose with the target. The rapid response of the projectile allows utilizing less precise individual guidance commands, while providing acceptable overall accuracy.

Figure 14:
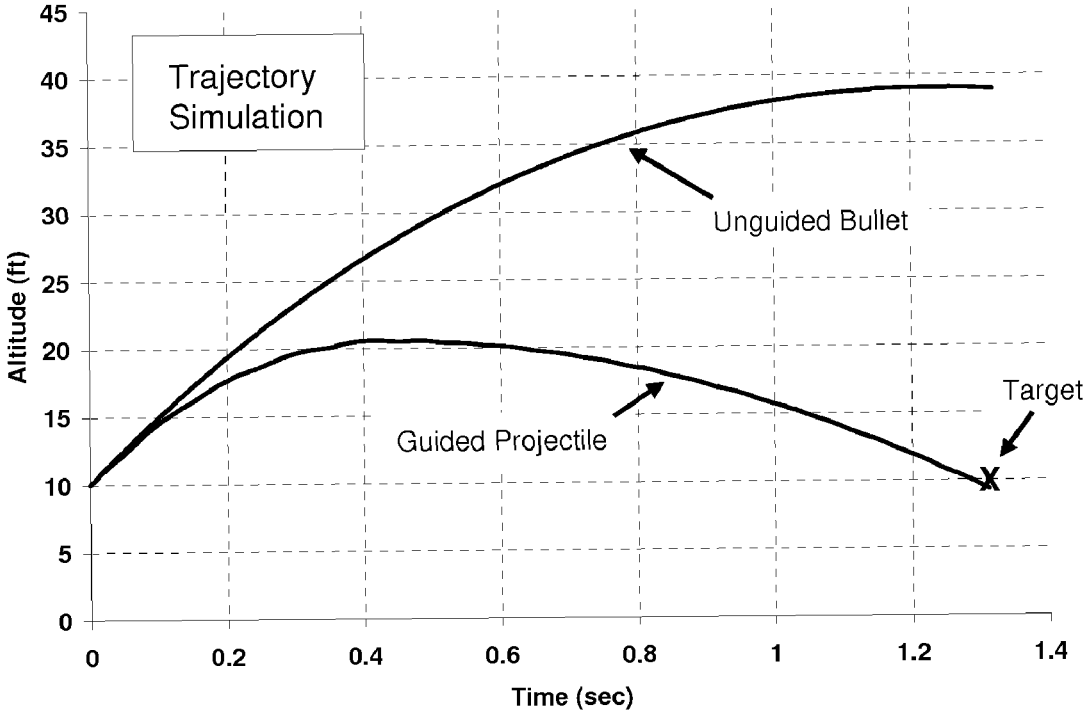
FIG. 14 is a graphical presentation of an analysis of the trajectory of an embodiment of a guided projectile according to the present invention.

The TAOS trajectory simulation of the exemplary guided projectile includes an aerodynamic model developed using the Missile Datcom code and mass properties obtained from the solid model of the projectile. For this simulation, the gun barrel is elevated 1 degree above the horizon and the muzzle velocity is 1000 m/s. The range of the target is 1000 m, and the target is positioned at the same altitude as the gun barrel (3 m). Without steering the projectile, the ballistic path of an unguided bullet would miss the target by 9 m flying above the target. The trajectory profile of the guided projectile compared to an unguided bullet with the same barrel exit conditions is illustrated in FIG. 14. Using a simple guidance system (e.g. "bang-bang") as described above, the accuracy of the guided projectile is greatly improved relative to the unguided projectile. The estimated target "miss" distance from this simulation is only about 0.2 m.

Figure 15:
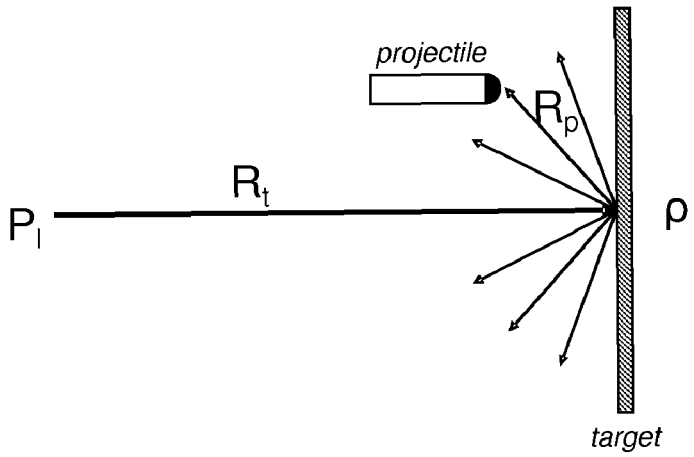
FIG. 15 is a schematic illustration of light reflected off of a target from a laser target designator as received by an optical sensor in a guided projectile according to embodiments of the present invention.

Commercially available InGaAs photo-detectors can be used as the optical sensor in guided projectiles according to the present invention. Based on the performance characteristics of known detectors, the required laser designator power to a detector signal to noise ratio of one can be computed. The required laser designator power can then be compared to the power output of available military laser designators, to demonstrate the functionality of embodiments of the invention. FIG. 15 illustrates a target illuminated by a laser target designator with light from the designator reflected off the target being received by an optical sensor located in the nose of the projectile. The following analysis of the configuration illustrated in FIG. 15 indicates commercially available optical sensors and available target designators are suitable for use with embodiments of the present invention.

The reflected light intensity at the projectile's sensor is equal to the intensity of the targeting laser, times the attenuation of the laser between the source and the target, times the reflectivity of the target, times the attenuation of the laser between the target and the sensor, times the area ratio of the sensor to the reflected light and can be given by the relation;

$$P_p = [P_t e^{-R_t/R_o} \rho e^{-R_p/R_o}] \frac{\pi r_L^2}{2\pi R_p^2}. \quad \text{(Eqn. 20)}$$

Where:

$P_p$—power at the projectile sensor $P_1$—laser power

ρ—reflected hemispherical power ratio $R_t$—range to target $R_p$—range to projectile $R_o$—attenuation length $r_L$—radius of sensor lens Rearranging to solve for required laser power (Eqn. 20) becomes;

$$P_t = \frac{2P_pR_p^2}{(e^{-R_t/R_o})(e^{-R_p/R_o})\rho r_L^2}. \quad \text{(Eqn. 21)}$$

The attenuation length of light is a function of the scattering length and the absorption length. For this analysis we will assume clear air for which all losses are from scattering for suspended aerosols and is dependent upon the light wavelength λ, or;

$$R_o=[0.96\times10^{30}\,\mathrm{m}^{-3}]\lambda^4. \quad \text{(Eqn. 22)}$$

Assuming an infrared laser, the attenuation length is;

$$R_o=[0.96\times10^{30}\,\mathrm{m}^{-3}][1\times10^{-6}\,\mathrm{m}]^4=9.6\times10^5\,\mathrm{m}. \quad \text{(Eqn. 23)}$$

Referring to a datasheet for an exemplary InGaAs photodiode, such as available from Hamamatsu Photonics, Japan, as part No. G8198-01, a 0.08 mm optical sensor has a sensitivity of 0.95 A/W and dark current of 0.3 nA. Thus, the power required to achieve a signal to power ratio of one (threshold power) is;

$$P_{threshold} = \frac{I_d}{S} = \frac{0.3\times10^{-9}}{0.95} = 3.2\times10^{-10}W. \quad \text{(Eqn. 24)}$$

Where:

$I_d$—dark current

S—sensitivity

Substituting the threshold power and attenuation length into (Eqn. 21) and assuming a 0.25 inch lens, 2000 m for the range, and 0.225 reflectance (average reflectance of an exemplary target, e.g. a clean military "Humvee") yields;

$$P_t = \frac{2(3.2\times10^{-10}W)(2000\mathrm{m})^2}{(e^{-2000m/9.6\times10^5m})(e^{-2000m/9.6\times10^5m})(0.225)(3.2\times10^{-3}\mathrm{m})^2}. \quad \text{(Eqn. 25)}$$

Which gives, $$P_l=1.1\times10^3\,\mathrm{W}. \quad \text{(Eqn. 26)}$$

The performance of the US Army ultralight laser designator development program is published as producing 20 nanosecond pulses with 40 milliJoules of energy, which equates to $2\times10^6$ W which is three orders of magnitude more power that the required threshold power, illustrating laser target designation and guidance is well within limits for guided projectiles according to the present invention.

Figure 16:
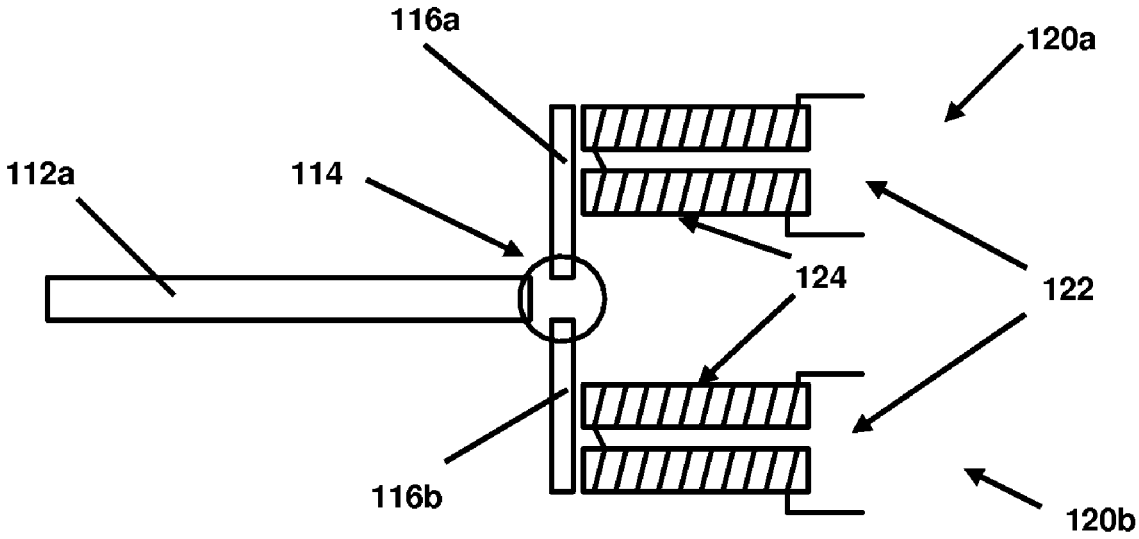
FIG. 16 is a schematic block diagram illustration of another embodiment of an electromagnetic actuator and control fin assembly according to the invention.

The above described exemplary embodiments present several variants of the invention but do not limit the scope of the invention. Those skilled in the art will appreciate that the present invention can be implemented in other equivalent ways. For example, FIG. 16 presents another embodiment of a control fin and electromagnetic actuator assembly according to the present invention (indicia as described above). This alternate configuration involves distributing the magnetic actuators to either side of the fin shafts. This doubles the usable cross sectional area available to each actuator. (A full projectile interior cross section is available for each of the two fin shafts.) The larger area allows the electromagnet coil to be shorter which also improves the magnetic core circuit. This change may necessitate moving the fins forward on the projectile's body. Additionally the actuator shafts can be mounted about ⅓ back from the leading edge of the fin. This placement reduces the torque required to rotate the fin while maintaining the tendency to return to a neutral position when the actuator is de-energized. The actual scope of the invention is intended to be defined in the following claims.

What is claimed is:

1. A non-spinning projectile self-guided to a laser designated target, the projectile having a center of gravity, a center of pressure and a length, the projectile comprising:

an optical sensor operatively arranged to detect light reflected from the laser designated target;

a counterbalance mass operatively arranged to cause the center of gravity of the projectile to be located forward of the center of pressure of the projectile;

a plurality of stabilizing strakes rigidly affixed to an exterior surface of the projectile, each of the plurality extending longitudinally along a portion of the projectile's length;

a plurality of control fins each pivotally mounted adjacent to a trailing edge of one of the plurality of stabilizing strakes, one or more of the plurality of control fins attached to each of one or more rotatable shafts, each rotatable shaft having an actuation lever and an opposed actuation lever;

a plurality of electromagnetic actuators each magnetically coupleable to one of the actuation lever and the opposed actuation lever of each rotatable shaft; and, a control and guidance electronics module operatively arranged to receive a signal from the optical sensor and generate therefrom, a control command for each of the plurality of electromagnetic actuators, causing the control fins to pivot in a controlled manner thereby guiding the projectile towards the target.

2. The projectile of claim 1 wherein the control command for each of the plurality of electromagnetic actuators consists of one of a power off command and a power on command, thereby providing non-proportional control of the plurality of control fins.

3. The projectile of claim 1 further comprising a sabot, the sabot operatively arranged to interface the projectile to a smooth bore gun barrel thereby preventing damage to the stabilizing strakes and control fins upon firing.

4. The projectile of claim 3 wherein the projectile and the sabot are operatively configured to comprise a combined diameter equal to or less than thirteen millimeters.

5. The projectile of claim 1 wherein the length is equal to or less than approximately four inches.

6. The projectile of claim 1 wherein the plurality of control fins are operatively arranged to be pivotable through approximately six degrees of rotation.

7. A non-spinning projectile self-guided to a laser designated target, the projectile having a center of gravity, a center of pressure, a length and fore and aft ends, the projectile comprising:

an infrared optical sensor operatively arranged to detect light reflected from the laser designated target, the optical sensor fixedly mounted proximal to the fore end of the projectile;

a counterbalance mass operatively arranged to cause the center of gravity of the projectile to be located forward of the center of pressure of the projectile, the counterbalance mass operatively connected to and aft of the optical sensor;

a plurality of stabilizing strakes rigidly affixed to an exterior surface of the projectile, each of the plurality extending longitudinally along a portion of the projectiles length and terminating proximal to the aft end of the projectile;

a plurality of control fins each pivotally mounted adjacent to a trailing edge of one of the plurality of stabilizing strakes, one or more of the plurality of control fins attached to each of one or more rotatable shafts, each rotatable shaft having an actuation lever and an opposed actuation lever attached thereto;

an actuation module disposed at the aft end of the projectile, the actuation module comprising a plurality of electromagnetic actuators each magnetically coupleable to one of the actuation lever and the opposed actuation lever of each rotatable shaft;

a control and guidance electronics module operatively arranged to receive a signal from the optical sensor and generate therefrom, a control command for each of the plurality of electromagnetic actuators, causing the control fins to pivot in a controlled manner thereby guiding the projectile towards the target; and, a sabot encasing a portion of the exterior surface of the projectile, the sabot operatively arranged to interface the projectile to a smooth bore gun barrel and prevent damage to the stabilizing strakes and control fins upon firing.

8. The projectile of claim 7 wherein the plurality of control fins comprises four control fins operatively arranged as a first pair and a second pair, the first pair of control fins commonly attached to a first rotatable shaft, second pair of control fins commonly attached to a second rotatable shaft, the first pair of control fins oriented substantially orthogonal to the second pair of control fins, thereby providing pitch and yaw control of the projectile's trajectory.

9. The projectile of claim 8 wherein the plurality of electromagnetic actuators comprises four electromagnetic actuators configured as a first pair of actuators operatively arranged to control the first pair of control fins and a second pair of actuators operatively arranged to control the second pair of control fins.

10. The projectile of claim 9 wherein each actuation lever and each opposed actuation lever attached to each rotatable shaft comprises a magnetically coupling portion to coupling to each associated electromagnetic actuator.

11. The projectile of claim 7 wherein the counterbalance mass comprises one or more selected from a tungsten counterbalance mass and a depleted uranium counterbalance mass.

12. The projectile of claim 7 wherein the control and guidance electronics module comprises one or more batteries.

13. The projectile of claim 12 wherein the one or more batteries comprises one or more selected from a lithium ion battery and a shock activated battery.

* * * * *